US007669938B2

(12) United States Patent
Hall et al.

(10) Patent No.: US 7,669,938 B2
(45) Date of Patent: Mar. 2, 2010

(54) CARBIDE STEM PRESS FIT INTO A STEEL BODY OF A PICK

(76) Inventors: David R. Hall, 2185 S. Larsen Pkwy., Provo, UT (US) 84606; John Bailey, 2185 S. Larsen Pkwy., Provo, UT (US) 84606; Ronald B. Crockett, 2185 S. Larsen Pkwy., Provo, UT (US) 84606

( * ) Notice: Subject to any disclaimer, the term of this patent is extended or adjusted under 35 U.S.C. 154(b) by 71 days.

(21) Appl. No.: 11/774,227

(22) Filed: Jul. 6, 2007

(65) Prior Publication Data

US 2008/0169698 A1 Jul. 17, 2008

Related U.S. Application Data

(63) Continuation-in-part of application No. 11/733,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 11/766,903 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/18* (2006.01)

(52) U.S. Cl. ..... 299/111; 299/113

(58) Field of Classification Search ..... 299/111, 299/113, 106–108
See application file for complete search history.

(56) References Cited

U.S. PATENT DOCUMENTS 2,004,315 A 6/1935 Fean (Continued)

*Primary Examiner*—John Kreck
(74) *Attorney, Agent, or Firm*—Tyson J. Wilde; Phillip W. Townsend, III

(57) ABSTRACT

In one aspect of the present invention, a high impact resistant tool, having a super hard material is bonded to a cemented metal carbide substrate at a non-planar interface. The cemented metal carbide substrate is bonded to a front end of a cemented metal carbide segment. A stem is formed in the base end of the carbide segment opposite the front end and the carbide stem is press fitted into bore of a steel body.

19 Claims, 11 Drawing Sheets

U.S. PATENT DOCUMENTS 3,746,396 A 7/1973 Radd
3,807,804 A 4/1974 Kniff
3,820,848 A * 6/1974 Kniff ..... 299/107
3,932,952 A 1/1976 Helton
3,945,681 A 3/1976 White
4,005,914 A 2/1977 Newman
4,006,936 A 2/1977 Crabiel
4,201,421 A 5/1980 Den Besten
4,277,106 A 7/1981 Sahley
4,484,644 A 11/1984 Cook
4,489,986 A 12/1984 Dziak
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,944,559 A 7/1990 Sionnet
5,011,515 A 4/1991 Frushour
5,154,245 A 10/1992 Waldenstrom
5,251,964 A 10/1993 Ojanen
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,725,283 A * 3/1998 O'Neill ..... 299/104
5,823,632 A 10/1998 Burkett
5,845,547 A 12/1998 Sollami
5,875,862 A 3/1999 Jurewicz
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,056,911 A 5/2000 Griffin
6,113,195 A 9/2000 Mercier
6,170,917 B1 1/2001 Heinrich
6,196,636 B1 3/2001 Mills
6,196,910 B1 3/2001 Johnson
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,709,065 B2 3/2004 Peay
6,719,074 B2 4/2004 Tsuda
6,733,087 B2 * 5/2004 Hall et al. ..... 299/113
6,739,327 B2 5/2004 Sollami
6,758,530 B2 * 7/2004 Sollami ..... 299/111
6,824,225 B2 11/2004 Stiffler
6,889,890 B2 5/2005 Yamazaki
6,966,611 B1 11/2005 Sollami
6,994,404 B1 2/2006 Sollami
7,097,258 B2 * 8/2006 Sollami ..... 299/102
7,204,560 B2 4/2007 Mercier
2003/0209366 A1 * 11/2003 McAlvain ..... 175/427
2004/0026983 A1 2/2004 McAlvain
2004/0065484 A1 4/2004 McAlvain
2006/0237236 A1 10/2006 Sreshta

* cited by examiner

CARBIDE STEM PRESS FIT INTO A STEEL BODY OF A PICK

CROSS REFERENCE TO RELATED APPLICATIONS

This application is a continuation-in-part of U.S. patent application Ser. No. 11/773,271 which was filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007 now U.S. Pat. No. 7,475,948. U.S. patent application Ser. No. 11/742,304 is a continuation of U.S. patent application Ser. No. 11/742,261 which was filed on Apr. 30, 2007 now U.S. Pat. No. 7,469,971. U.S. patent application Ser. No. 11/742,261 is a continuation-in-part of U.S. patent application Ser. No. 11/464,008 which was filed on Aug. 11, 2006 now U.S. Pat. No. 7,338,135. U.S. patent application Ser. No. 11/464,008 is a continuation-in-part of U.S. patent application Ser. No. 11/463,998 which was filed on Aug. 11, 2006 now U.S. Pat. No. 7,384,105. U.S. patent application Ser. No. 11/463,998 is a continuation-in-part of U.S. patent application Ser. No. 11/463,990 which was filed on Aug. 11, 2006 now U.S. Pat. No. 7,320,505. U.S. patent application Ser. No. 11/463,990 is a continuation-in-part of U.S. patent application Ser. No. 11/463,975 which was filed on Aug. 11, 2006 now U.S. Pat. No. 7,445,294. U.S. patent application Ser. No. 11/463,975 is a continuation-in-part of U.S. patent application Ser. No. 11/463,962 which was filed on Aug. 11, 2006 now U.S. Pat. No. 7,413,256. U.S. patent application Ser. No. 11/463,962 is a continuation-in-part of U.S. patent application Ser. No. 11/463,953, which was also filed on Aug. 11, 2006 now U.S. Pat. No. 7,464,993. The present application is also a continuation-in-part of U.S. patent application Ser. No. 11/695,672 which was filed on Apr. 3, 2007 now U.S. Pat. No. 7,396,086. U.S. patent application Ser. No. 11/695,672 is a continuation-in-part of U.S. patent application Ser. No. 11/686,831 filed on Mar. 15, 2007 now U.S. Pat. No. 7,568,770. All of these applications are herein incorporated by reference for all that they contain.

BACKGROUND OF THE INVENTION

Formation degradation, such as asphalt milling, mining, or excavating, may result in wear on attack tools. Consequently, many efforts have been made to extend the life of these tools.

U.S. Pat. No. 3,830,321 to McKenry et al., which is herein incorporated by reference for all that it contains, discloses an excavating tool and a bit for use therewith in which the bit is of small dimensions and is mounted in a block in which the bit is rotatable and which block is configured in such a manner that it can be welded to various types of holders so that a plurality of blocks and bits mounted on a holder make an excavating tool of selected style and size.

U.S. Pat. No. 6,102,486 to Briese, which is herein incorporated by reference for all that it contains, discloses a frustum cutting insert having a cutting end and a shank end and the cutting end having a cutting edge and inner walls defining a conical tapered surface. First walls in the insert define a cavity at the inner end of the inner walls and second walls define a plurality of apertures extending from the cavity to regions external the cutting insert to define a powder flow passage from regions adjacent the cutting edge, past the inner walls, through the cavity and through the apertures.

U.S. Pat. No. 4,944,559 to Sionnet et al., which is herein incorporated by reference for all that it contains, discloses a body of a tool consisting of a single-piece steel component. The housing for the composite abrasive component is provided in this steel component. The working surface of the body has, at least in its component-holder part, and angle at the lower vertex of at least 20% with respect to the angle at the vertex of the corresponding part of a metallic carbide tool for working the same rock. The surface of the component holder is at least partially covered by an erosion layer of hard material.

U.S. Pat. No. 5,873,423 to Briese, which is herein incorporated by reference for all that it contains, discloses a frustum cutting bit arrangement, including a shank portion for mounting in, and to be retained by, a rotary cutting tool body, the shank portion having an axis, an inner axial end, and an outer axial end. A head portion has an axis coincident with the shank portion axis, a front axial end, and a rear axial end, the rear end coupled to the shank portion outer end, and the front end having a conical cavity therein diminishing in diameter from the front end toward the rear end. A frustum cutting insert has an axis coincident with the head portion axis, a forward axial end, a back axial end, and an outer conical surface diminishing in diameter from the forward end toward the back end, the conical cavity in a taper lock. In variations of the basic invention, the head portion may be rotatable with respect to the shank portion, the frustum cutting insert may comprise a rotating cutter therein, and combinations of such features may be provided for different applications.

BRIEF SUMMARY OF THE INVENTION

In one aspect of the present invention, a high impact resistant attack tool, having a super hard material is bonded to a cemented metal carbide substrate at a non-planar interface. The cemented metal carbide substrate is bonded to a front end of a cemented metal carbide segment. A stem is formed in the base end of the carbide segment opposite the front end and the carbide stem is press fitted into a bore of a steel body.

In some embodiments, the bore may be formed in an interfacial surface of the steel body which may comprise a diameter equal to or less than a diameter of the base end of the carbide segment. At least one reentrant may be formed in the interfacial surface of the steel body that is in contact with the carbide segment and the at least one reentrant may comprise a radius of 0.100 to 0.010 inches. At least one reentrant may be formed in the base end of the carbide segment that is in contact with the steel body.

In some embodiments, a length of the stem may be 35 to 110 percent of a depth of the bore formed in the steel body. The press fit between the carbide stem and the steel body may comprise an interference of 0.001 to 0.010 inches. The stem may have a diameter that is 75 to 355 percent of a diameter of the cemented metal carbide substrate. The base end of the carbide segment may have a ground finish.

In some embodiments, wherein the super hard material may comprise a substantially conical surface with a side which forms a 35 to 55 degree angle with a central axis of the tool. The super hard material may comprise a substantially pointed geometry which may comprise a convex side. The substantially pointed geometry may comprise a concave side. The super hard material may comprise a substantially pointed geometry with an apex which may have a 0.050 to 0.125 inch radius. At the interface the substrate may comprise a tapered surface starting from a cylindrical rim of the substrate and ending at an elevated flatted central region formed in the substrate. The flatted region may comprise a diameter of 0.125 to 0.250 inches.

In some embodiments, the super hard material and the substrate may comprise a total thickness of 0.200 to 0.700 inches from the apex to a base of the substrate. The super hard material may comprise a 0.100 to 0.500 inch thickness from the apex to the non-planar interface. The super hard material may be diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof.

The high impact tool may be incorporated in drill bits, shear bits, milling machines, indenters, mining picks, asphalt picks, asphalt bits, trenching machines, or combinations thereof. The tool may comprise the characteristic of withstanding an impact greater than 80 joules.

DETAILED DESCRIPTION OF THE INVENTION AND THE PREFERRED EMBODIMENT

Figure 1:
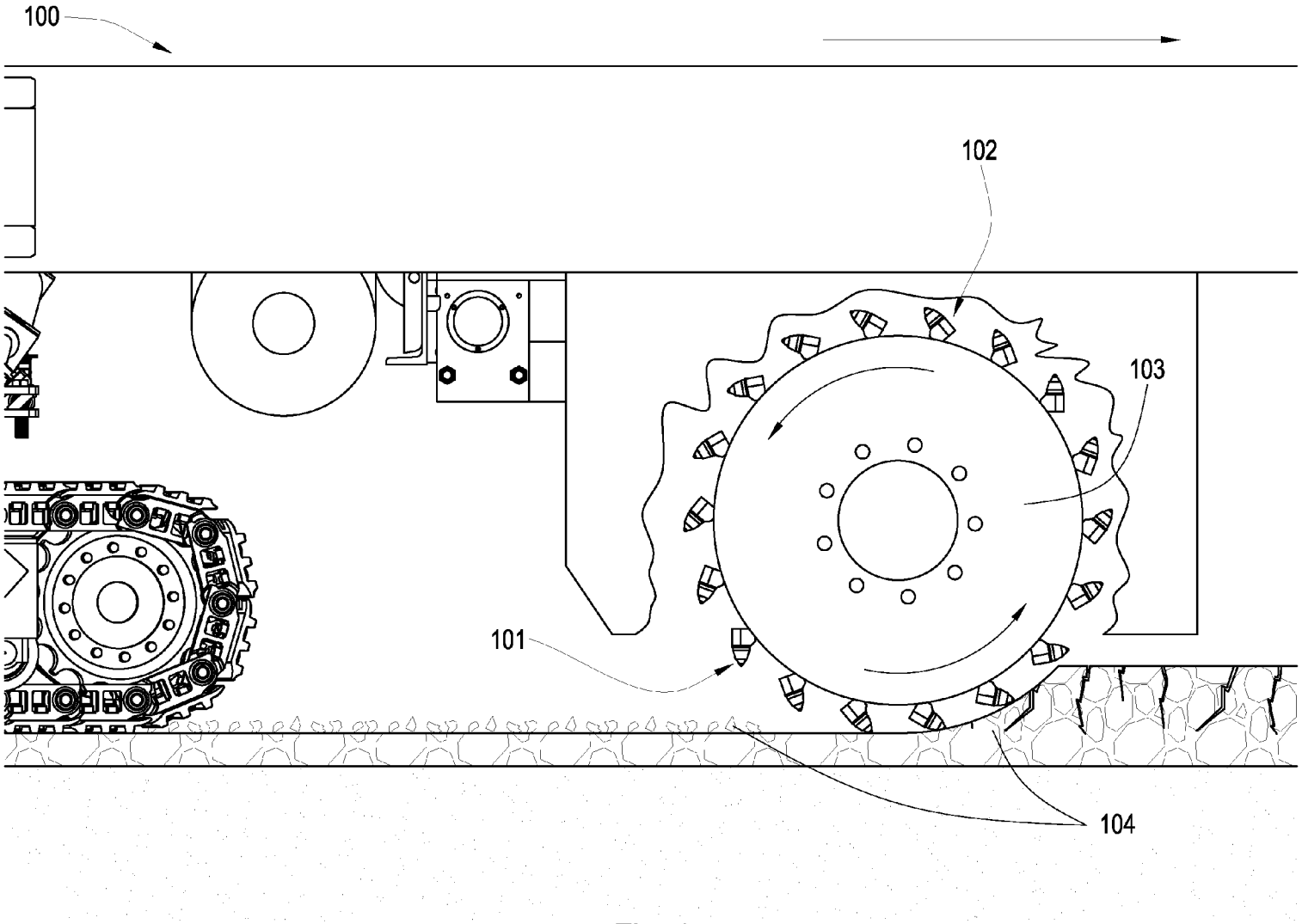
FIG. 1 is a cross-sectional diagram of an embodiment of a plurality of tools on a rotating drum attached to a motor vehicle.

FIG. 1 is a cross-sectional diagram of an embodiment of a plurality of tools 101 attached to a rotating drum 103 connected to the underside of a pavement recycling machine 100. The recycling machine 100 may be a cold planer used to degrade man-made formations such as pavement 104 prior to the placement of a new layer of pavement. Tools 101 may be attached to the drum 103 bringing the tools 101 into engagement with the formation. A holder 102 or block is attached to the rotating drum 103, and the tool 101 is inserted into the holder 102. The holder 102 or block may hold the tool 101 at an angle offset from the direction of rotation, such that the tool 101 engages the pavement at a preferential angle.

Figure 2:
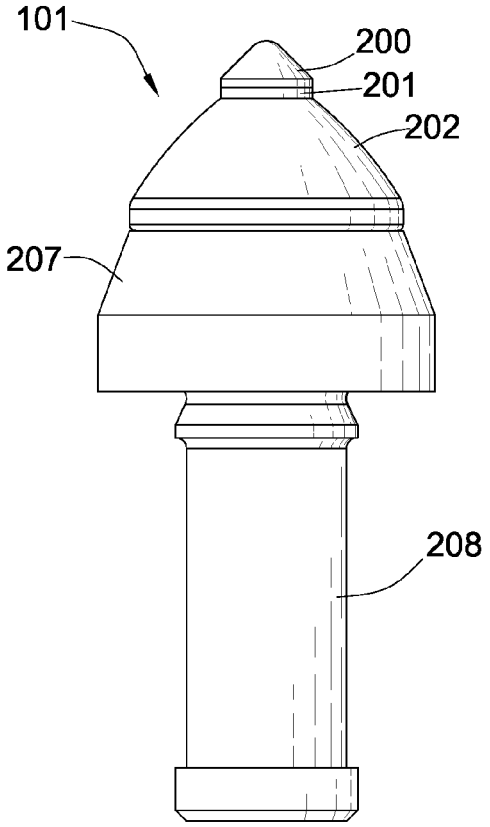
FIG. 2 is an orthogonal diagram of an embodiment of a tool.
Figure 2A:
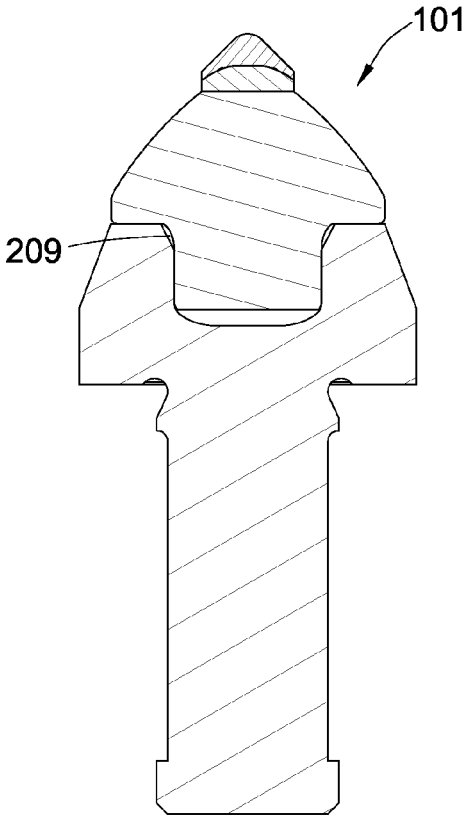
FIG. 2*a* is a cross-sectional diagram of an embodiment of a tool.
Figure 2B:
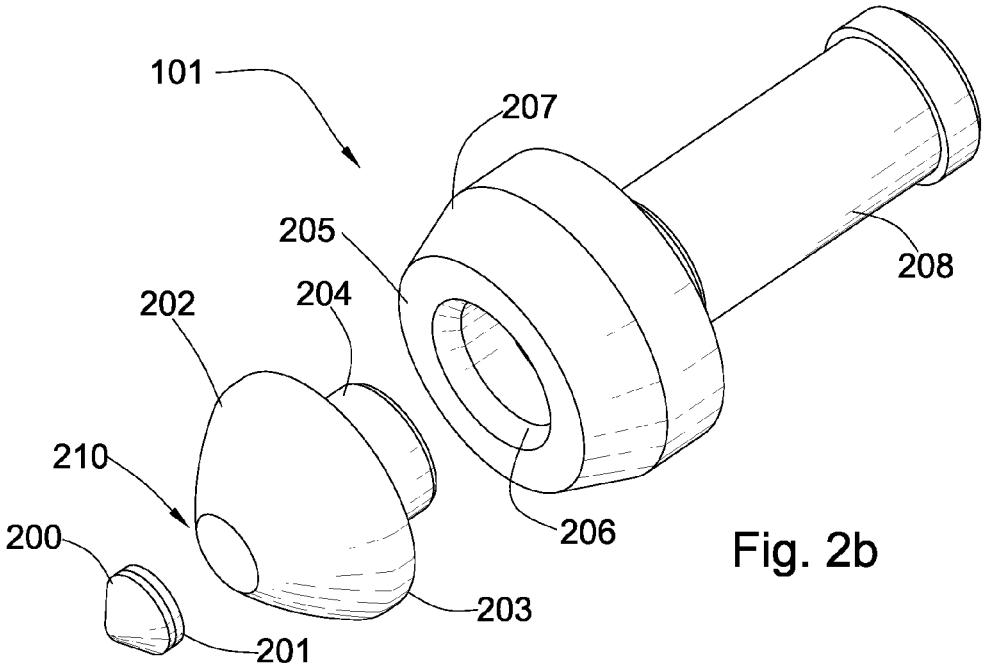
FIG. 2*b* is an exploded diagram of an embodiment of a tool.

Now referring to FIG. 2 through 2*a*, the tool 101 comprises a super hard material 200 bonded to a cemented metal carbide substrate 201 at a non-planar interface. The cemented metal carbide substrate 201 is bonded to a front end 210 of a cemented metal carbide segment 202. The carbide segment 202 may have a ground finish. A stem 204 is formed in the base end 203 of the carbide segment 202 opposite the front end 210. The stem may have a diameter that is 75 to 355 percent of a diameter of the cemented metal carbide substrate. The carbide stem 204 is press fitted with an interference of 0.001 to 0.010 inches into a bore 206 of a steel body 207. The stem 204 has a diameter that is 75 to 355 percent of a diameter of the carbide substrate 201. The steel body 207 may have a shank 208 adapted for connection to a degradation assembly.

FIG. 2*a* discloses a cross-sectional diagram of the tool 101. At least one reentrant 209 may be formed in an interfacial surface 205 of the steel body 207 that may be in contact with the carbide segment 202. The reentrant may have a radius of 0.100 to 0.010 inches. In some embodiments, the reentrant may comprise a conic geometry. The reentrant may also be 0.005 inches to an inch deep. The corners of the stems may also be rounded, canted or chamfered.

Figure 3A:
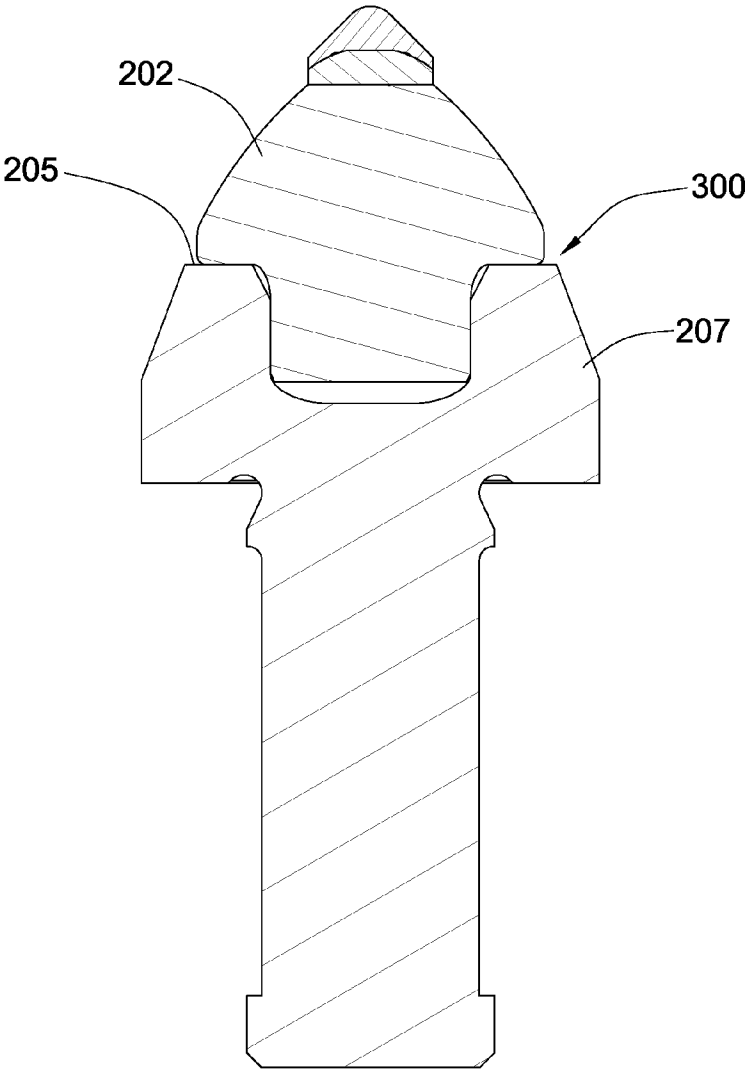
FIG. 3*a* is a cross-sectional diagram of another embodiment of a tool.
Figure 3:
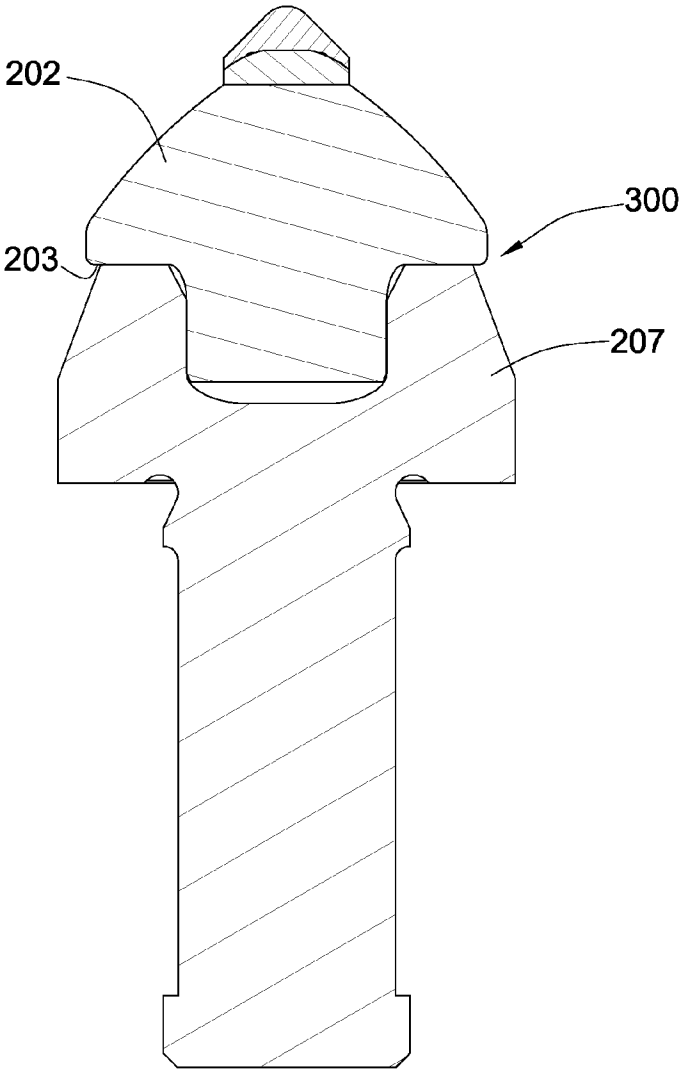
FIG. 3 is a cross-sectional diagram of another embodiment of a tool.

FIG. 3 discloses another embodiment of the tool 101 where a diameter of the base end 203 of the carbide segment 202 has a larger diameter than the interfacial surface 205 of the steel body 207. The larger diameter on the carbide segment 202 may reduce the amount of wear on the steel body 207 since carbide is more resistant than steel. FIG. 3*a* discloses a tool 101 where the diameter of the interfacial surface 205 of the steel body 207 is larger than the diameter of the base end 203 of the carbide segment 202.

Figure 4A:
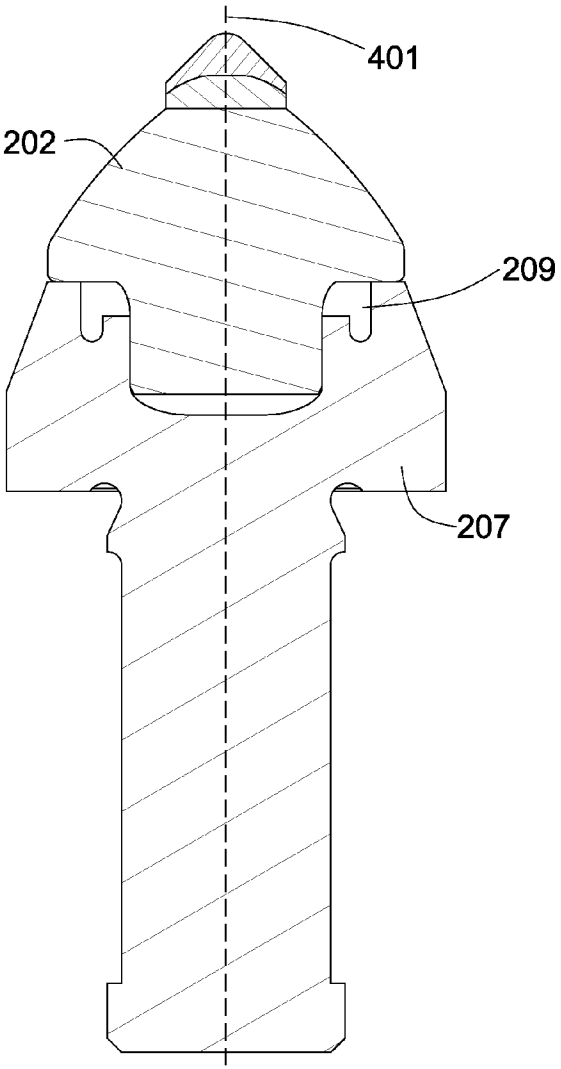
FIG. 4*a* is a cross-sectional diagram of another embodiment of a tool.
Figure 4:
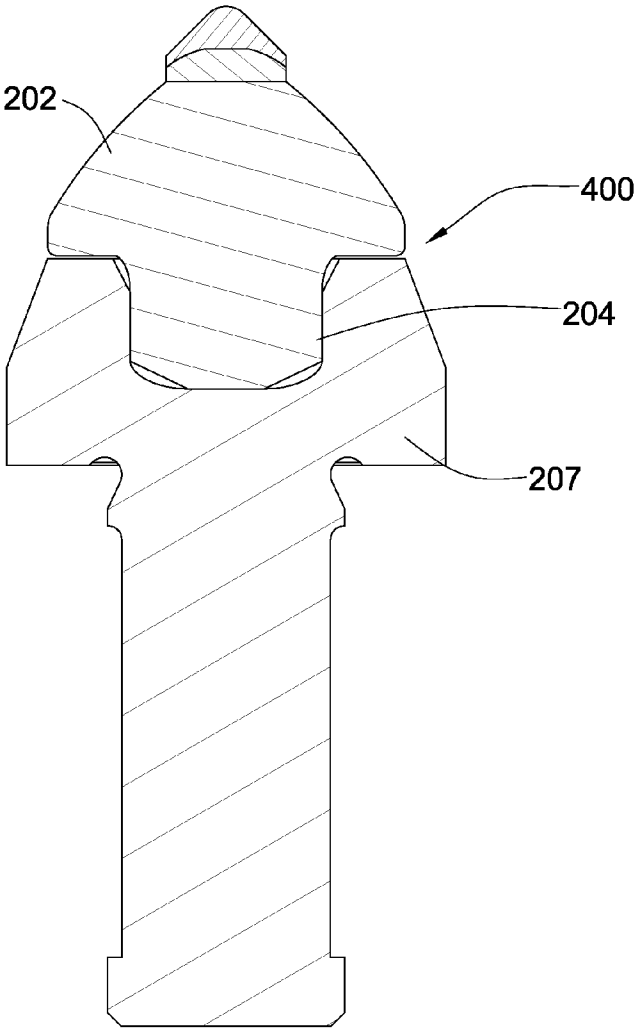
FIG. 4 is a cross-sectional diagram of another embodiment of a tool.

Now referring to FIG. 4, the stem 204 may have a length greater than a depth of the bore 206 forming a substantially small gap 400 between the carbide segment 202 and the steel body 207. It is believed that the gap 400 may allow the carbide segment 202 to bend when a under load.

Figure 5A:
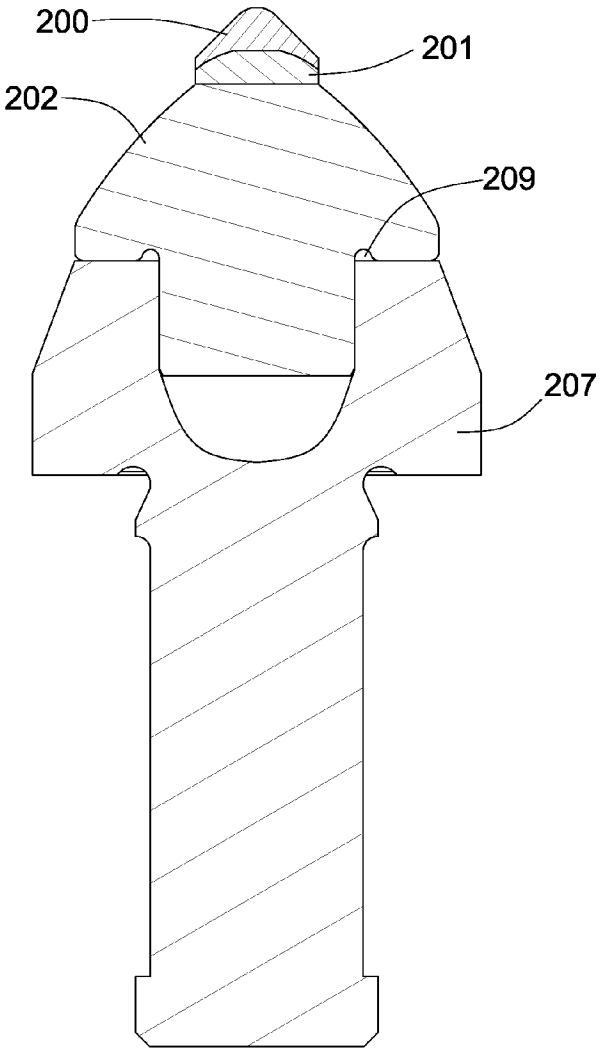
FIG. 5*a* is a cross-sectional diagram of another embodiment of a tool.
Figure 5:
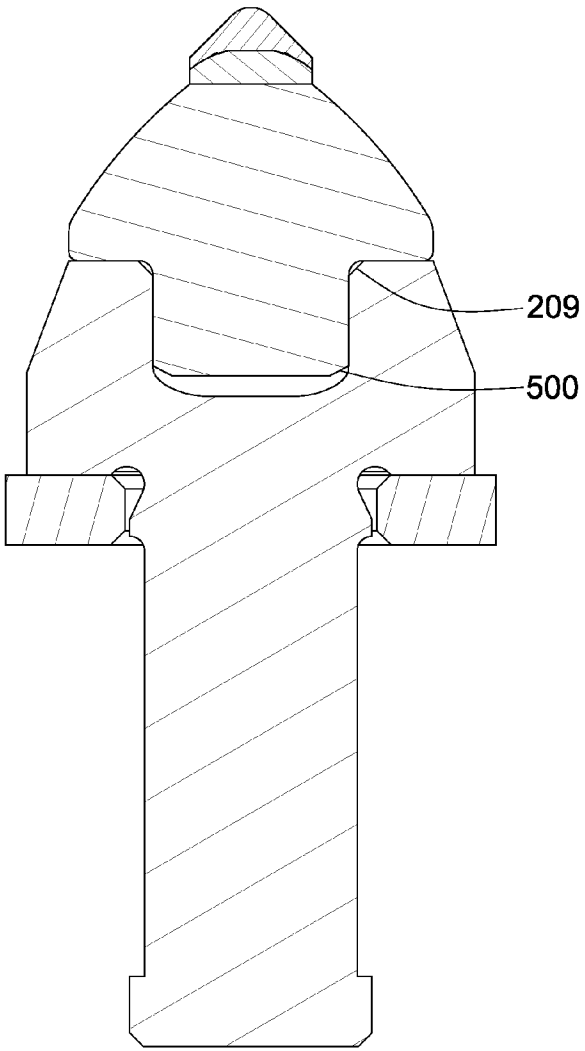
FIG. 5 is a cross-sectional diagram of another embodiment of a tool.
Figure 5B:
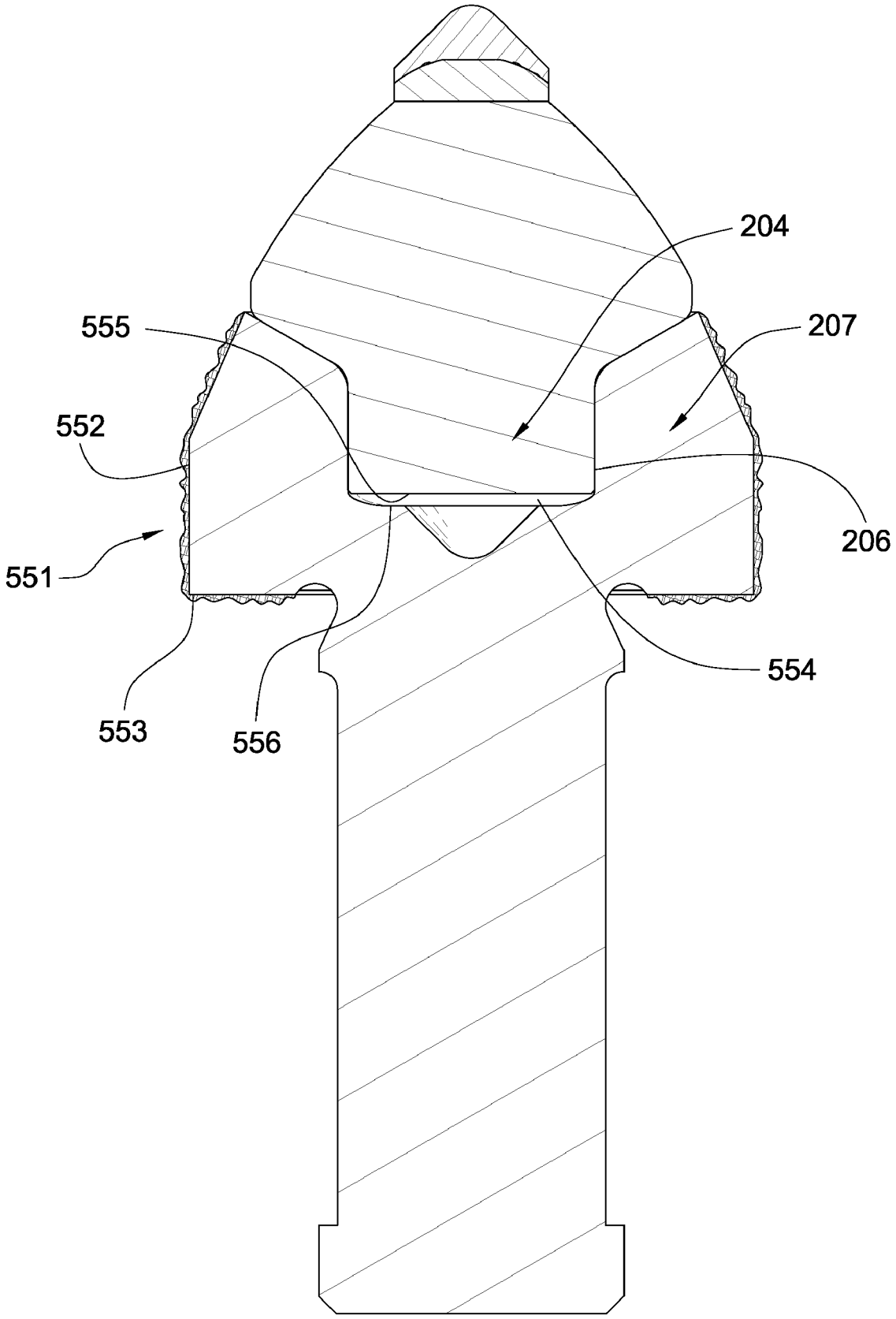
FIG. 5*b* is a cross-sectional diagram of another embodiment of a tool.

FIG. 4*a* through 5*a* disclose additional embodiments of the reentrants 209 formed in the tool 101. FIG. 4*a* discloses reentrants 209 formed in the interfacial surface 205 with an initial depth which increases substantially further out from the center axis 401 of the tool 101. FIG. 5 discloses a tool 101 with reentrants 209 of a substantially smaller radius. The stem also comprises a chamfer 500. FIG. 5*a* discloses a tool 101 with reentrants 209 formed in the base end 203 of the carbide segment 202. FIG. 5*b* discloses a inverse conical shaped void 550 in the bottom of the bore. There may be a gap 554 between the floor 556 of the bore 206 and bottom 555 of the stem 204. This gap may provide some flexibility to the pick. 551. The pick may also comprise some hard-facing 551 on the side of the steel body side 552 or on the underside 553 of the steel body 207.

Figure 6A:
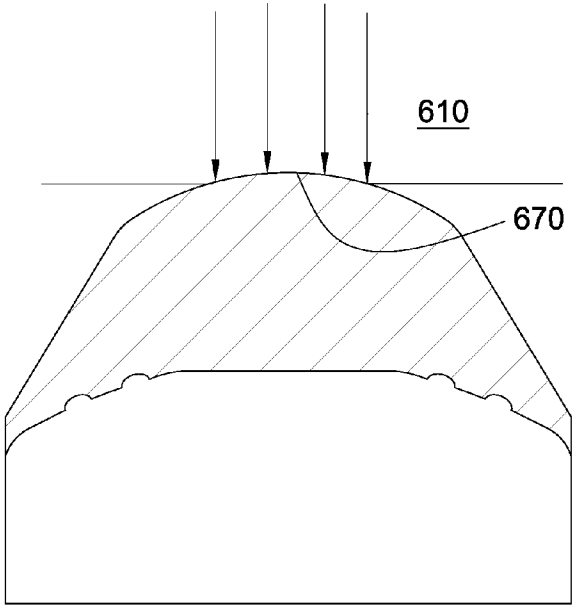
FIG. 6*a* is a cross-sectional diagram of another embodiment of a super hard material bonded to a substrate.
Figure 6:
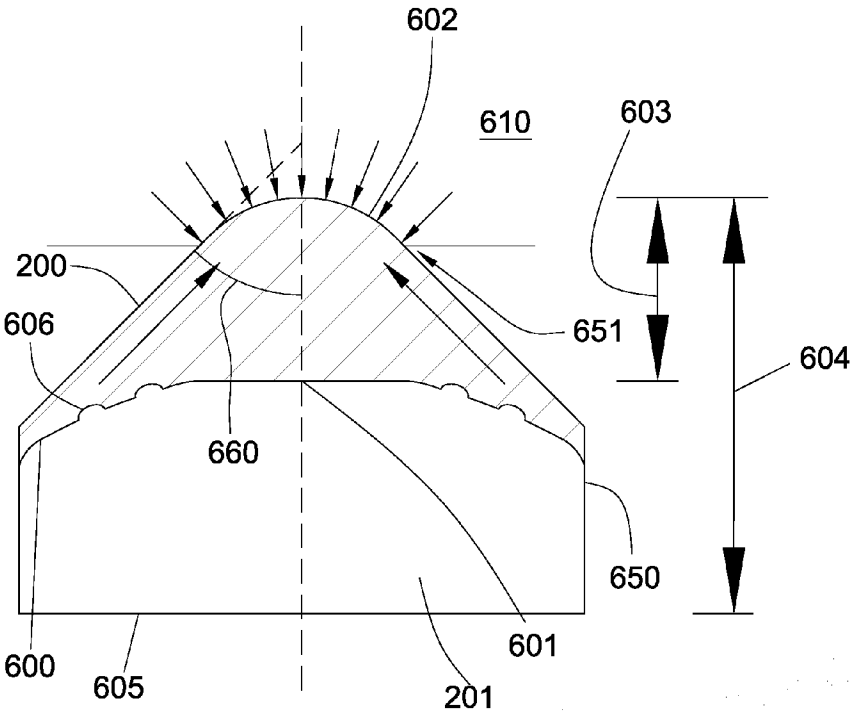
FIG. 6 is a cross-sectional diagram of an embodiment of a super hard material bonded to a substrate.
Figure 6B:
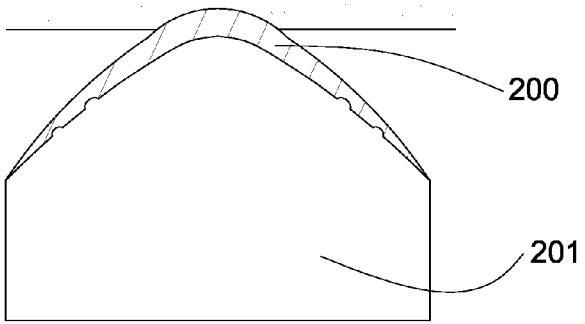
FIG. 6*b* is a cross-sectional diagram of another embodiment of a super hard material bonded to a substrate.

Now referring to FIG. 6, the substrate 201 comprises a tapered surface 600 starting from a cylindrical rim 650 of the substrate 201 and ending at an elevated, flatted, central region 601 formed in the substrate 201. The super hard material 200 comprises a substantially pointed geometry 700 with a sharp apex 602 comprising a radius of 0.050 to 0.125 inches. It is believed that the apex 602 is adapted to distribute impact forces across the flatted region 601, which may help prevent the super hard material 200 from chipping or breaking. The super hard material 200 may comprise a thickness 603 of 0.100 to 0.500 inches from the apex to the flatted region 601 or non-planar interface. The super hard material 200 and the substrate 201 may comprise a total thickness 604 of 0.200 to 0.700 inches from the apex 602 to a base 605 of the substrate 201. The sharp apex 602 may allow the tool to more easily cleave rock or other formations.

The pointed geometry 700 of the super hard material 200 may comprise a side which forms a 35 to 55 degree angle 660 with a central axis of the substrate 201 and super hard material 200, though the angle 660 may preferably be substantially 45 degrees. The included angle may be a 90 degree angle, although in some embodiments, the included angle is 85 to 95 degrees.

The pointed geometry 700 may also comprise a convex side or a concave side. The tapered surface 600 of the substrate may incorporate nodules 606 at the interface between the super hard material 200 and the substrate 201, which may provide more surface area on the substrate 201 to provide a stronger interface. The tapered surface 600 may also incorporate grooves, dimples, protrusions, reverse dimples, or combinations thereof. The tapered surface 600 may be convex, as in the current embodiment, though the tapered surface may be concave.

Comparing FIGS. 6 and 6*a*, the advantages of having a pointed apex 602 as opposed to a blunt apex 670 may be seen. FIG. 6 is a representation of a pointed geometry 700 which was made by the inventors of the present invention, which has a 0.094 inch radius apex and a 0.150 inch thickness from the apex to the non-planar interface. FIG. 6*a* is a representation of another geometry also made by the same inventors comprising a 0.160 inch radius apex and 0.200 inch thickness from the apex to the non-planar geometry. The geometries of FIGS. 6 and 6*a* were compared to each other in a drop test performed at Novatek International, Inc. located in Provo, Utah. Using an Instron Dynatup 9250G drop test machine, the geometries were secured in a recess in the base of the machine burying the substrate 201 portions and leaving the super hard material 200 exposed. The base of the machine was reinforced from beneath with a solid steel pillar to make the structure more rigid so that most of the impact force was felt in the super hard material 200 rather than being dampened. The target 610 comprising tungsten carbide 16% cobalt grade mounted in steel backed by a 19 kilogram weight was raised to the needed height required to generate the desired potential force, then dropped normally onto the geometries. Each geometry was tested at a starting 5 joules, if the geometries withstood the joules they were retested with a new carbide target 610 at an increased increment of 10 joules till the geometries failed. The pointed apex 602 of FIG. 6 surprisingly required about 5 times more joules to break than the thicker geometry of FIG. 6*a*.

It is believed that the sharper geometry 700 of FIG. 6 penetrated deeper into the tungsten carbide target 610, thereby allowing more surface area of the super hard material 200 to absorb the energy from the falling target 610 by beneficially buttressing the penetrated portion of the super hard material 200 effectively converting bending and shear loading of the substrate 201 into a more beneficial compressive force drastically increasing the load carrying capabilities of the super hard material 200. On the other hand it is believed that since the embodiment of FIG. 6*a* is blunter the apex hardly penetrated into the tungsten carbide target 610 thereby providing little buttress support to the substrate 201 and caused the super hard material 200 to fail in shear/bending at a much lower load with larger surface area using the same grade of diamond and carbide. The average embodiment of FIG. 6 broke at about 130 joules while the average geometry of FIG. 6*a* broke at about 24 joules. It is believed that since the load was distributed across a greater surface area in the embodiment of FIG. 6 it was capable of withstanding a greater impact than that of the thicker embodiment of FIG. 6*a*.

Surprisingly, in the embodiment of FIG. 6, when the super hard geometry 700 finally broke, the crack initiation point 651 was below the radius of the apex 602. This is believed to result from the tungsten carbide target 610 pressurizing the flanks of the pointed geometry 700 (number not shown in the fig.) in the penetrated portion, which results in the greater hydrostatic stress bading in the pointed geometry 700. It is also believed that since the radius was still intact after the break, that the pointed geometry 700 will still be able to withstand high amounts of impact, thereby prolonging the useful life of the pointed geometry 700 even after chipping.

Three different types of pointed geometries were tested. This first type of geometry is disclosed in FIG. 5*b* which comprises a 0.035 inch super hard geometry and an apex with a 0.094 inch radius. This type of geometry broke in the 8 to 15 joules range. The blunt geometry with the radius of 0.160 inches and a thickness of 0.200, which the inventors believed would outperform the other geometries broke, in the 20-25 joule range. The pointed geometry 700 with the 0.094 thickness and the 0.150 inch thickness broke at about 130 joules. The impact force measured when the super hard geometry with the 0.160 inch radius broke was 75 kilo-newtons. Although the Instron drop test machine was only calibrated to measure up to 88 kilo-newtons, which the pointed geometry 700 exceeded when it broke, the inventors were able to extrapolate that the pointed geometry 700 probably experienced about 105 kilo-newtons when it broke.

The super hard material 200 having the feature of being thicker than 0.100 inches or having the feature of a 0.075 to 0.125 inch radius is not enough to achieve the super hard material's 200 optimal impact resistance, but it is synergistic to combine these two features. In the prior art, it was believed that a sharp radius of 0.075 to 0.125 inches of a super hard material such as diamond would break if the apex were too sharp, thus rounded and semispherical geometries are commercially used today.

The performance of the present invention is not presently found in commercially available products or in the prior art.

Figure 7:
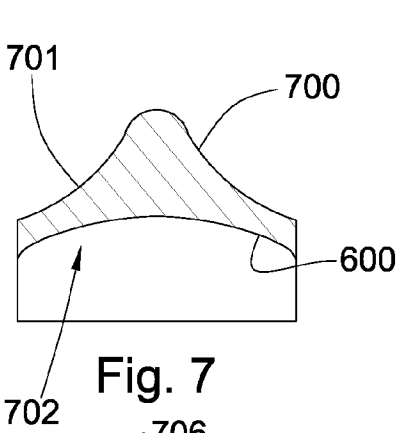
FIG. 7 is a cross-sectional diagram of another embodiment of a super hard material bonded to a substrate.
Figure 7A:
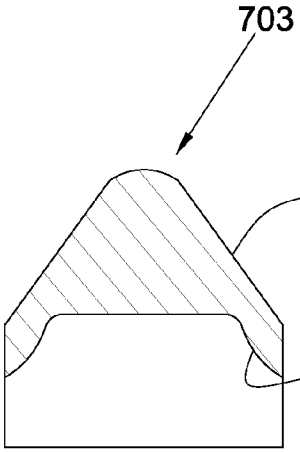
FIG. 7*a* is a cross-sectional diagram of another embodiment of a super hard material bonded to a substrate.
Figure 7B:
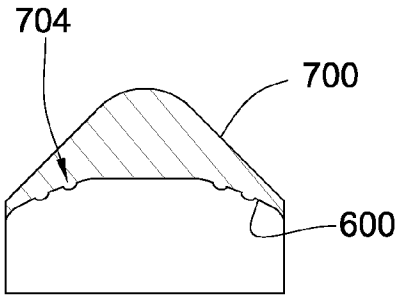
FIG. 7*b* is a cross-sectional diagram of another embodiment of a super hard material bonded to a substrate.
Figure 7C:
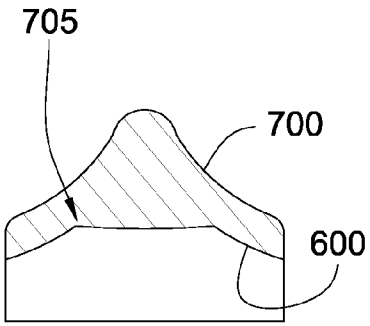
FIG. 7*c* is a cross-sectional diagram of another embodiment of a super hard material bonded to a substrate.
Figure 7D:
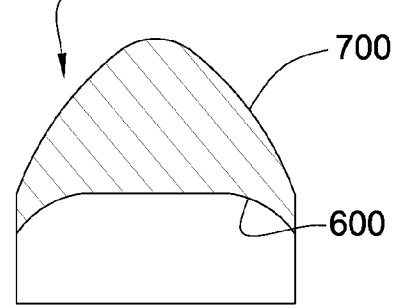
FIG. 7*d* is a cross-sectional diagram of another embodiment of a super hard material bonded to a substrate.
Figure 7E:
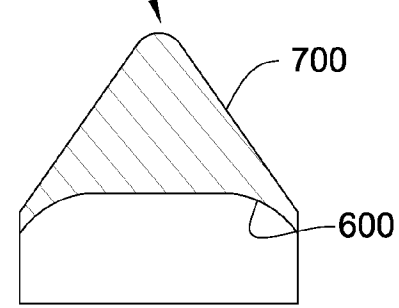
FIG. 7*e* is a cross-sectional diagram of another embodiment of a super hard material bonded to a substrate.
Figure 7F:
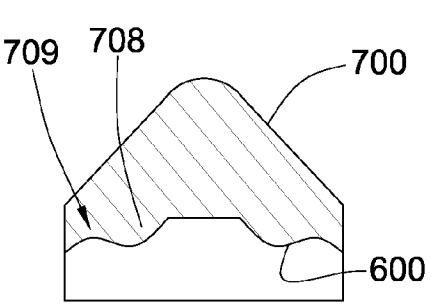
FIG. 7*f* is a cross-sectional diagram of another embodiment of a super hard material bonded to a substrate.

FIGS. 7 through 7*f* disclose various possible embodiments comprising different combinations of tapered surface 600 and pointed geometries 700. FIG. 7 illustrates the pointed geometry with a concave side 701 and a continuous convex substrate geometry 702 at the interface. FIG. 7*a* comprises an embodiment of a thicker super hard material 703 from the apex to the non-planar interface, while still maintaining this radius of 0.075 to 0.125 inches at the apex. FIG. 7*b* illustrates grooves 704 formed in the substrate to increase the strength of the interface. FIG. 7*c* illustrates a slightly concave geometry 705 at the interface with concave sides. FIG. 7*d* discloses slightly convex sides 706 of the pointed geometry 700 while still maintaining the 0.075 to 0.125 inch radius. FIG. 7*e* discloses a flat sided pointed geometry 707. FIG. 7*f* discloses concave and convex portions 708, 709 of the substrate 201 with a generally flatted central portion.

Figure 7G:
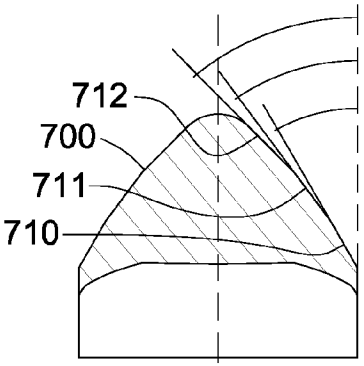
FIG. 7*g* is a cross-sectional diagram of another embodiment of a super hard material bonded to a substrate.

Now referring to FIG. 7*g*, the super hard material 200 (number not shown in the fig.) may comprise a convex surface comprising different general angles at a lower portion 710, a middle portion 711, and an upper portion 712 with respect to the central axis of the tool. The lower portion 710 of the side surface may be angled at substantially 25 to 33 degrees from the central axis, the middle portion 711, which may make up a majority of the convex surface, may be angled at substantially 33 to 40 degrees from the central axis, and the upper portion 712 of the side surface may be angled at about 40 to 50 degrees from the central axis.

Figure 8:
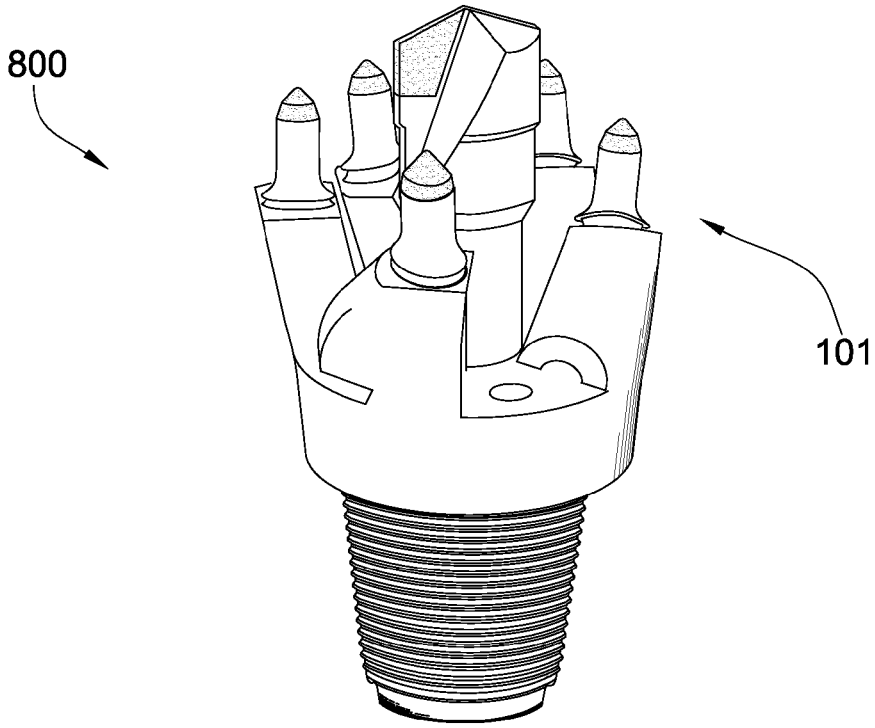
FIG. 8 is an orthogonal diagram of an embodiment of a drill bit.
Figure 8A:
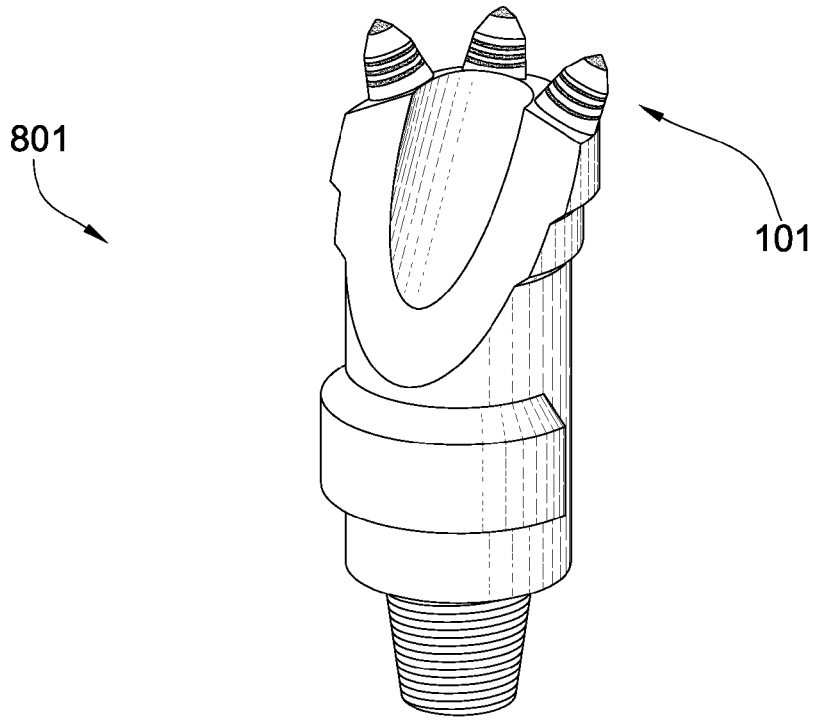
FIG. 8*a* is an orthogonal diagram of another embodiment of a drill bit.
Figure 9:
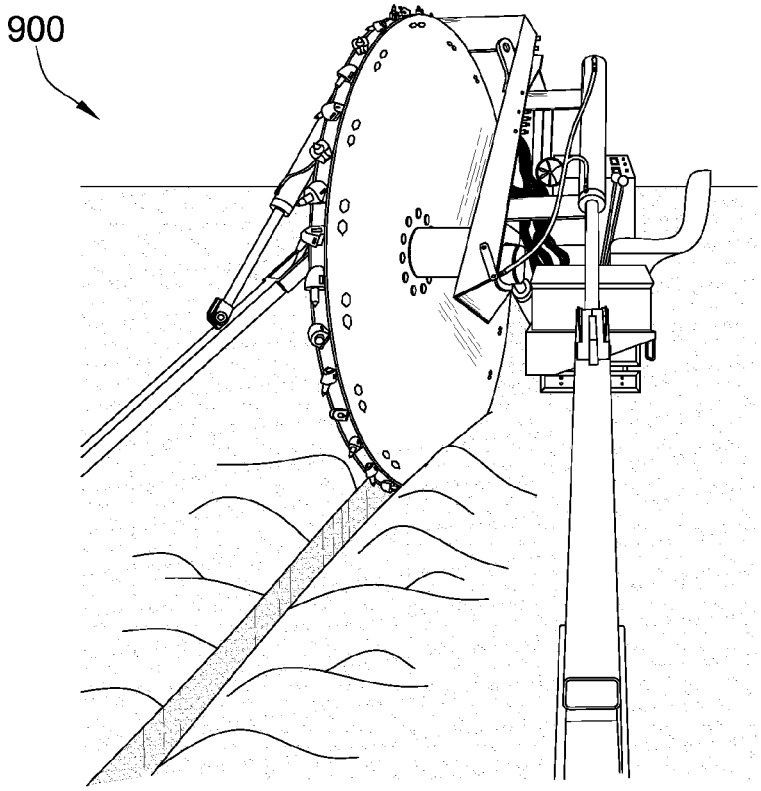
FIG. 9 is a perspective diagram of an embodiment of a trencher.
Figure 10:
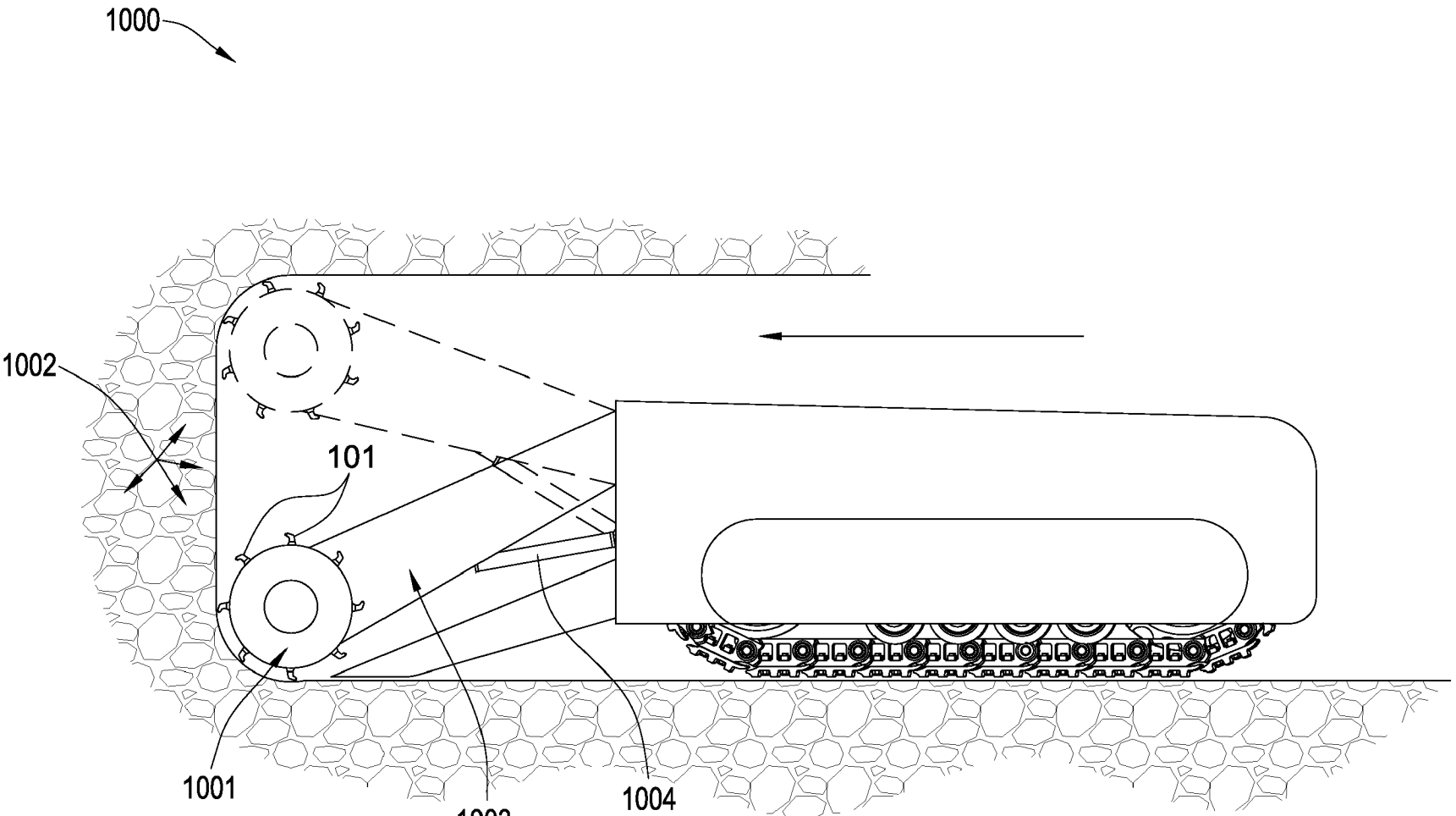
FIG. 10 is an orthogonal diagram of an embodiment of a coal trencher.

Tools 101 may be used in various applications. FIGS. 8 through 10 disclose various wear applications that may be incorporated with the present invention. FIG. 8 discloses a drill bit 800 typically used in water well drilling. FIG. 8*a* discloses a drill bit 801 typically used in subterranean, horizontal drilling. These bits 800, 801, and other bits, may be consistent with the present invention.

Figure 9A:
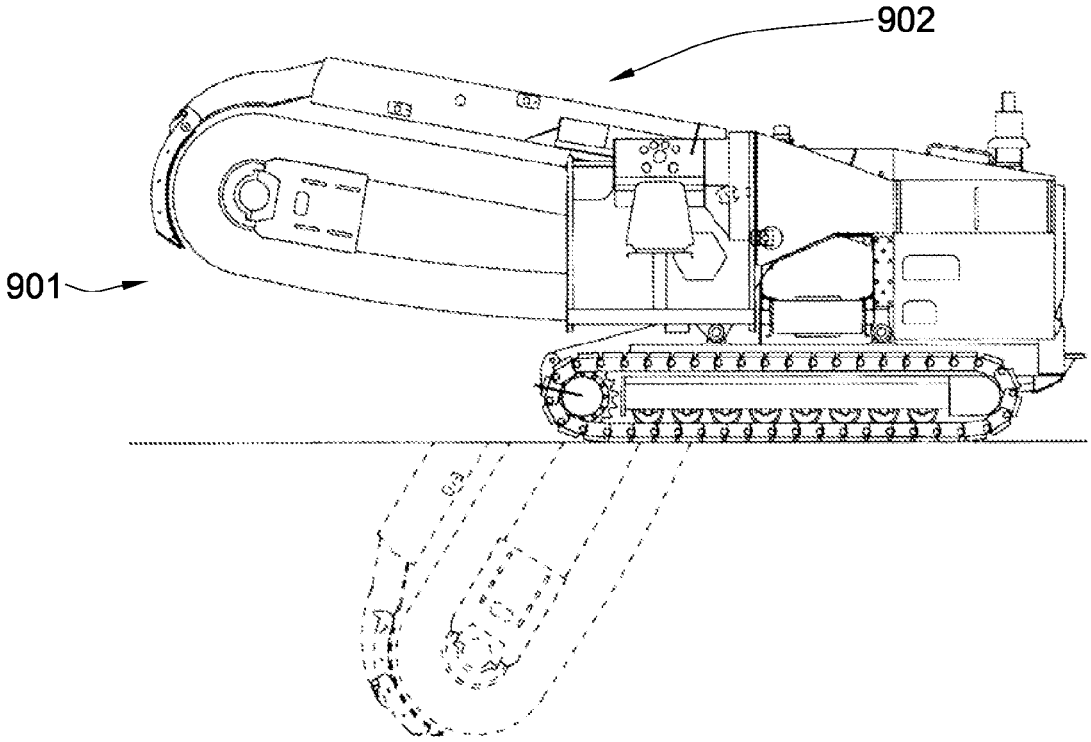
FIG. 9*a* is an orthogonal diagram of another embodiment of a trencher.

The tool 101 may be used in a trenching machine, as disclosed in FIGS. 9 through 9*a*. Tools 101 may be disposed on a rock wheel trenching machine 900 as disclosed in FIG. 9. Referring to FIG. 9*a*, the tools 101 may be placed on a chain that rotates around an arm 902 of a chain trenching machine 901.

FIG. 10 is an orthogonal diagram of an embodiment of a coal trencher 1000. A plurality of tools 101 are connected to a rotating drum 1001 that is degrading coal 1002. The rotating drum 1001 is connected to an arm 1003 that moves the drum 1001 vertically in order to engage the coal 1002. The arm 1003 may move by that of a hydraulic arm 1004, it may also pivot about an axis or a combination thereof. The coal trencher 1000 may move about by tracks, wheels, or a combination thereof. The coal trencher 1000 may also move about in a subterranean formation. The coal trencher 1000 may be in a rectangular shape providing for easy mobility about the formation.

Other applications that involve intense wear of machinery may also be benefited by incorporation of the present invention. Milling machines, for example, may experience wear as they are used to reduce the size of material such as rocks, grain, trash, natural resources, chalk, wood, tires, metal, cars, tables, couches, coal, minerals, chemicals, or other natural resources.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool, comprising:

a super hard material bonded to a cemented metal carbide substrate at a non-planar interface;

the cemented metal carbide substrate is bonded to a front end of a cemented metal carbide segment;

a stem is formed in the base end of the carbide segment opposite the front end;

the carbide stem is press fitted into a bore of a steel body;

wherein at least one reentrant is formed in the interfacial surface of the steel body that is in contact with the carbide segment.

2. The tool of claim 1, wherein the super lard material comprises a substantially conical surface with a side which forms a 35 to 55 degree angle with a central axis of the tool.

3. The tool of claim 1, wherein the super hard material has a substantially pointed geometry which comprises a convex side.

4. The tool of claim 3, wherein the substantially pointed geometry comprises a concave side.

5. The tool of claim 1, wherein at the interface the substrate comprises a tapered surface staffing from a cylindrical rim of the substrate and ending at an elevated flatted central region formed in the substrate.

6. The tool of claim 5, wherein the flatted region comprises a diameter of 0.125 to 0.250 inches.

7. The tool of claim 1, wherein the super hard material comprises a substantially pointed geometry with an apex comprising 0.050 to 0.125 inch radius.

8. The tool of claim 7, wherein the super hard material and the substrate comprise a total thickness of 0.200 to 0.700 inches from the apex to a base of the substrate.

9. The tool of claim 7, wherein the super hard material comprises a 0.100 to 0.500 inch thickness from the apex to the non-planar interface.

10. The tool of claim 1, wherein the super hard material is diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof.

11. The tool of claim 1, wherein the high impact tool is incorporated in drill bits, shear bits, milling machines, indenters, mining picks, asphalt picks, asphalt bits, trenching machines, or combinations thereof.

12. The tool of claim 1, wherein the tool comprises the characteristic of withstanding impact greater than 80 joules.

13. The tool of claim 1, wherein the bore is formed in an interfacial surface of the steel body which comprises a diameter equal to or less than a diameter of the base end of the carbide segment.

14. The tool of claim 1, wherein the at least one reentrant has a radius of 0.100 to 0.010 inches.

15. The tool of claim 1, wherein at least one reentrant is formed in the base end of the carbide segment that is in contact with the steel body.

16. The tool of claim 1, wherein a length of the stem is 35 to 110 percent of a depth of the bore formed in the steel body.

17. The tool of claim 1, wherein the press fit between the carbide stem and the steel body has an interference of 0.001 to 0.010 inches.

18. The tool of claim 1, wherein the stem has a diameter that is 75 to 355 percent of a diameter of the cemented metal carbide substrate.

19. The tool of claim 1, wherein the base end of the carbide segment has a ground finish.

* * * * *

UNITED STATES PATENT AND TRADEMARK OFFICE

CERTIFICATE OF CORRECTION

PATENT NO. : 7,669,938 B2
APPLICATION NO. : 11/774227
DATED : March 2, 2010
INVENTOR(S) : David R. Hall et al.

It is certified that error appears in the above-identified patent and that said Letters Patent is hereby corrected as shown below:

In the Claims

In column 8, claim 2, line 7, after "wherein the super" replace "lard" with --hard--.

In column 8, claim 5, line 16, after "a tapered surface" replace "staffing" with --starting--.

Signed and Sealed this
Fifteenth Day of May, 2012

David J. Kappos

David J. Kappos
*Director of the United States Patent and Trademark Office*